US006446596B1

(12) United States Patent
Moser et al.

(10) Patent No.: US 6,446,596 B1
(45) Date of Patent: Sep. 10, 2002

(54) METHOD OF OPERATING AN INTERNAL COMBUSTION ENGINE

(75) Inventors: Winfried Moser, Ludwigsburg; Matthias Philipp, Vaihingen/Enz; Dirk Mentgen, Schwieberdingen; Michael Oder, Illingen; Georg Mallebrein, Korntal-Muenchingen; Christian Koehler, Erligheim; Juergen Foerster, Ingersheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,608

(22) PCT Filed: Mar. 24, 1999

(86) PCT No.: PCT/DE99/00871

§ 371 (c)(1),
(2), (4) Date: Feb. 23, 2000

(87) PCT Pub. No.: WO99/49199

PCT Pub. Date: Sep. 30, 1999

(30) Foreign Application Priority Data

Mar. 26, 1998 (DE) ..... 198 13 382

(51) Int. Cl.[7] ..... F02B 17/00
(52) U.S. Cl. ..... 123/295; 123/305
(58) Field of Search ..... 123/295, 305, 123/436

(56) References Cited

U.S. PATENT DOCUMENTS

| | | | | |
|---|---|---|---|---|
| 5,385,129 A | | 1/1995 | Eyeberg | |
| 6,050,232 A | * | 4/2000 | Grob et al. | 123/295 |
| 6,089,206 A | * | 7/2000 | Suzuki et al. | 123/295 |
| 6,148,790 A | * | 11/2000 | Schulmeister | 123/295 |

FOREIGN PATENT DOCUMENTS

| | | |
|---|---|---|
| EP | 0 538 890 | 4/1993 |
| EP | 0 829 631 | 3/1998 |
| FR | 2 752 267 | 2/1998 |

* cited by examiner

*Primary Examiner*—John Kwon
(74) *Attorney, Agent, or Firm*—Kenyon & Kenyon

(57) ABSTRACT

An internal combustion engine in for a motor vehicle in (1) is described. The internal combustion engine (1) has an injection valve with which fuel can be injected directly into a combustion chamber either during a compression phase in a first operating mode or during an intake phase in a second operating mode. In addition, a control unit is provided for shifting between the two operating modes and for differential control and/or regulation of the performance quantities that influence the actual moment of the internal combustion engine in both operating modes as a function of a setpoint moment. A change in the actual moment during a shifting operation is determined by the control unit and at least one of the performance quantities is influenced by the control unit as a function thereof.

14 Claims, 5 Drawing Sheets

METHOD OF OPERATING AN INTERNAL COMBUSTION ENGINE

FIELD OF THE INVENTION

Background Information

The present invention relates to a method of operating an internal combustion engine in a motor vehicle in particular, where fuel is injected directly into a combustion chamber either during a compression phase in a first operating mode or during an intake phase in a second operating mode, where shifting takes place between the two operating modes, and where the performance quantities that influence the actual moment of the internal combustion engine are controlled and/or regulated differently as a function of a setpoint moment in both operating modes. In addition, the present invention concerns an internal combustion engine for a motor vehicle in particular, having an injection valve with which fuel can be injected directly into a combustion chamber either during a compression phase in a first operating mode or during an intake phase in a second operating mode, and having a control unit for shifting between the two operating modes and for differential control and/or regulation of performance quantities that influence the actual moment of the internal combustion engine in both operating modes as a function of a setpoint moment.

Systems for direct injection of fuel into the combustion chamber of an internal combustion engine are conventional in general. A distinction is made between stratified operation as a first operating mode and homogeneous operation as the second mode. Stratified operation is used at relatively low loads on the internal combustion engine in particular, while homogeneous operation is used at relatively high loads.

In stratified operation, fuel is injected into the combustion chamber during the compression phase of the internal combustion engine, so there is a cloud of fuel in the immediate vicinity of a sparkplug at the time of ignition. This injection may occur in various ways. For example, it is possible for the injected cloud of fuel to be at the sparkplug and be ignited by it during or immediately after injection. It is also possible for the injected cloud of fuel to be carried to the sparkplug by the motion of a charge and only then ignited. There is not a uniform distribution of fuel with either combustion method, but instead there is a stratified charge.

The advantage of stratified operation is that the internal combustion engine can handle lower loads with a very small amount of fuel. However, higher loads cannot be handled by stratified operation.

In homogeneous operation which is intended for such higher loads, fuel is injected during the intake phase of the internal combustion engine, so that turbulence can be created in the fuel, which is thus readily distributed in the combustion chamber. Homogeneous operation thus corresponds approximately to the operation of internal combustion engines where fuel is injected into the intake manifold in the traditional manner. If necessary, homogeneous operation may also be used at lower loads.

In stratified operation, the throttle valve in the intake manifold leading to the combustion chamber is opened wide, and combustion is controlled and/or regulated only by the fuel mass to be injected. In homogeneous operation, the throttle valve is opened and closed as a function of the required moment, and the fuel mass to be injected is controlled and/or regulated as a function of the air flow intake.

In both operating modes, i.e., in stratified operation and in homogeneous operation, the fuel mass to be injected is additionally controlled and/or regulated at an optimum level from the standpoint of saving fuel, reducing exhaust, etc., as a function of a plurality of additional performance quantities. The control and/or regulation here is different in both operating modes.

The internal combustion engine must be shifted from stratified operation to homogeneous operation and back again. In stratified operation, the throttle valve is opened wide, and air is thus supplied largely without throttling, but in homogeneous operation the throttle valve is only partially opened, thus reducing the supply of air. Especially when shifting from stratified operation to homogeneous operation, the ability of the intake manifold leading to the combustion chamber to store air must be taken into account. If this is not taken into account, shifting (from one type of operation to another) can lead to an increase in the moment delivered by the internal combustion engine.

SUMMARY

The object of this present invention is to provide a method for operating an internal combustion engine so that improved shifting between the operating modes is possible.

This object is achieved with a method of the type defined in and with an internal combustion engine according to the present invention by determining a change in the actual moment during a shifting operation and influencing at least one of the performance quantities as a function thereof.

On the basis of the determination of changes in the actual moment during the shifting operation, it is possible to detect irregular running or bucking while shifting. After bucking has been detected, the irregular running can be counteracted by influencing performance quantities. It is thus possible to prevent irregular running or bucking when shifting from homogeneous operation to stratified operation or vice versa. Shifting operations between the two operating modes are thus improved in particular with regard to smoother running and thus greater comfort.

In an advantageous embodiment of the present invention, the change in the actual moment is determined when shifting from the first operating mode to the second. This is a simple but effective method of detecting changes in the actual moment in a quasi-steady-state manner.

In another advantageous embodiment of the present invention, the change in the actual moment is determined in particular in succession at different fillings of the combustion chamber. In this way, dynamic shifting jerk is detected in a quasi-steady-state manner in dynamic operation of the internal combustion engine. This shifting jerk can be counteracted in the sense of minimizing it by dynamically influencing the performance quantities of the internal combustion engine.

In an advantageous embodiment of the present invention, the change in the actual moment is determined as a function of the measured rpm of the internal combustion engine. This achieves the result that a change in the actual moment and thus any bucking, etc., can be detected with the help of the rpm sensor which is already present anyway. This avoids the need for additional sensors or other additional components.

In an advantageous embodiment of the present invention, irregular running values are determined for the individual cylinders. Changes in the actual moment of the internal combustion engine can be deduced from these irregular running values. It is thus possible with the help of irregular running values to detect fluctuations in rpm or bucking of an internal combustion engine. Irregular running values can be determined in various ways. It is thus possible to provide an irregular running sensor to measure the irregular running values. Likewise, irregular running values can be derived from the rpm of the internal combustion engine, for example. It is important that irregular running values represent a measure of differences in torque between successive cylinders.

In an advantageous embodiment of the present invention, first only one of the cylinders is shifted, and thereafter at least one of the irregular running values of the shifted cylinder is compared with at least one of the irregular running values of at least one of the other cylinders. It is thus possible to determine whether there is a difference in torque between the shifted cylinder and cylinders that have not yet been shifted. In this way it is possible to determine whether there can be a difference in torque between the two operating modes between which the cylinders are to be shifted and thus whether bucking may occur.

It is especially advantageous if the other cylinders are to be shifted or not shifted as a function of the comparison. If the irregular running values of the shifted cylinder deviate significantly from the irregular running values of the cylinder not shifted, shifting can be suppressed to reliably prevent bucking of the internal combustion engine in this way. However, if there is no significant deviation, the other cylinders can also be shifted to the other operating mode. In this case, no bucking of the internal combustion engine is to be expected on the basis of the minor difference in irregular running values.

In an advantageous embodiment of the present invention, performance quantities of the internal combustion engine are influenced as a function of this comparison. Thus, when a deviation in irregular running values of a shifted cylinder from the irregular running values of the other cylinders is found, it is possible for the performance quantities of the internal combustion engine to be influenced in such a way as to minimize or eliminate this deviation. Shifting that has been started can be terminated to prevent bucking of the internal combustion engine. However, it is also possible to complete shifting, so that performance quantities are not influenced until subsequent shifting.

In an advantageous embodiment the influence on one of the performance quantities is implemented adaptively. There is thus a permanent correction of the shifting operation. It is thus possible, for example, to compensate for changes in the internal combustion engine, in particular wear phenomena, etc., over its lifetime. It is also possible to compensate for deviations between different internal combustion engines of the same type during startup.

In another advantageous embodiment of the present invention, the influence on one of the performance quantities is not implemented until the next shifting operation. This achieves the result that calculations according to the present invention can be performed between two shifting operations, so that sufficient time is available for them.

It is especially advantageous if the injected fuel mass is influenced in the sense of an increase in particular in the first operating mode. It is also advantageous if in the second operating mode, the firing angle and/or the firing point is influenced in the sense of a retard adjustment in particular. Due to these measures it is possible to influence the actual moment of the internal combustion engine when irregular running is detected during the shifting operation and thus reduce the irregular running. In particular, the two operating modes approach one another at the shifting point as a result of these measures.

Implementation of the method according to the present invention in the form of a control element provided for a control unit of an internal combustion engine in a motor vehicle in particular may be especially important. A program stored on the control element can be run on a processor, in particular a microprocessor, and is suitable for carrying out the method according to the present invention. In this case the invention is thus implemented by a program stored on the control element, so this control element with the program represents the present invention in the same way as the method which the program is suitable for executing. In particular, an (electronic) storage medium such as a read-only memory can be used as the control element.

DETAILED DESCRIPTION

Figure 1:
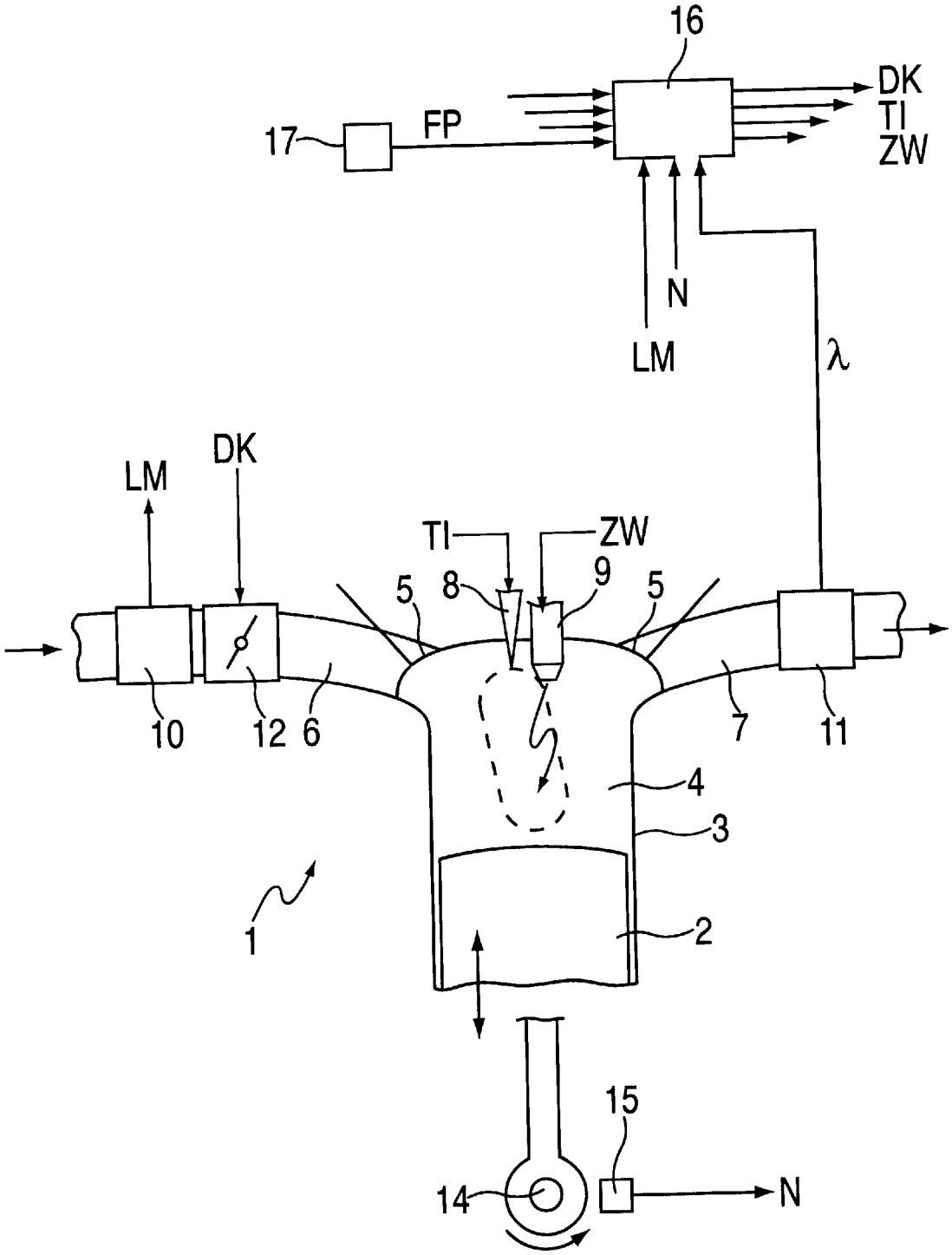
FIG. 1 shows a schematic block diagram of one embodiment of an internal combustion engine according to the present invention in a motor vehicle.

FIG. 1 shows an internal combustion engine 1 having a piston 2 moving back and forth in a cylinder 3. Cylinder 3 has a combustion chamber 4 connected by valves 5 to an intake manifold 6 and an exhaust pipe 7. In addition, combustion chamber 4 has an injection valve 8 controlled by a signal TI and a sparkplug 9 controlled by a signal ZW.

Intake manifold 6 has an air flow sensor 10, and exhaust pipe 7 may have a lambda sensor 11. Air flow sensor 10 measures the air flow of fresh air supplied to intake manifold 6 and generates a signal LM as a function thereof. Lambda sensor 11 measures the oxygen content of the exhaust gas in exhaust pipe 7 and generates a signal $\lambda$ as a function thereof.

A throttle valve 12 is accommodated in intake manifold 6 and its rotational position can be adjusted by a signal DK.

Throttle valve 12 is opened wide in a first operating mode, stratified operation of internal combustion engine 1. Fuel is injected by injection valve 8 into combustion chamber 4 during a compression phase created by piston 2, specifically being injected locally into the immediate vicinity of sparkplug 9 and at a suitable interval before the ignition point. Then, the fuel is ignited by sparkplug 9 to drive piston 2 by the expansion of the ignited fuel in the subsequent working phase.

In a second operating mode, homogeneous operation of internal combustion engine 1, throttle valve 12 is opened or closed partially as a function of the desired air flow supplied. Fuel is injected by injection valve 8 into combustion chamber 4 during an intake phase created by piston 2. Due to concomitant air intake, turbulence is created in the injected fuel, thus distributing it essentially uniformly throughout combustion chamber 4. Next the fuel/air mixture is compressed during the compression phase and then ignited by sparkplug 9. Piston 2 is driven by the expansion of the ignited fuel.

In stratified operation as well as in homogeneous operation, a rotational motion is induced in a crankshaft 14 by the driven piston, ultimately driving the wheels of the motor vehicle. An rpm sensor 15 is provided for crankshaft 14, generating a signal N as a function of rotational motion of crankshaft 14.

Fuel mass injected into combustion chamber 4 by injection valve 8 in stratified operation and in homogeneous operation is controlled and/or regulated by a control unit 16 with regard to low fuel consumption and/or low pollution emission in particular. To this end, control unit 16 is fitted with a microprocessor having a program suitable for executing aforesaid control and/or regulation stored in a memory medium, specifically a read-only memory.

Control unit 16 receives input signals representing performance quantities of the internal combustion engine measured by sensors. For example, control unit 16 is connected to air flow sensor 10, lambda sensor 11 and rpm sensor 15. In addition, control unit 16 is connected to a gas pedal sensor 17 generating a signal FP to indicate the position of a driver-operated gas pedal and thus the moment requested by the driver. Control unit 16 generates output signals with which the performance of the internal combustion engine can be influenced by actuators according to the desired control and/or regulation. For example, control unit 16 is connected to injection valve 8, sparkplug 9 and throttle valve 12, generating signals TI, ZW and DK required for controlling them.

Figure 2:
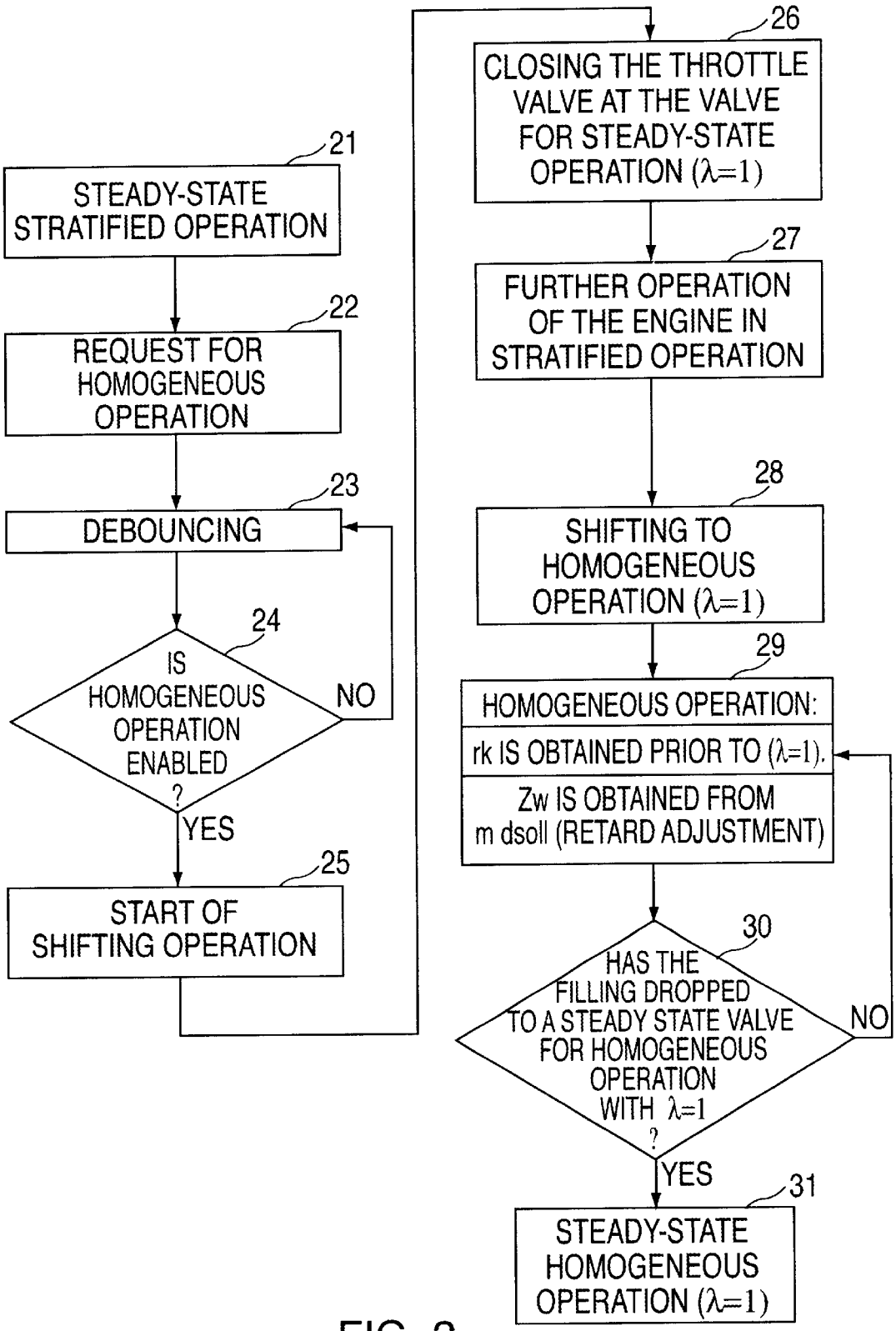
FIG. 2 shows a schematic flow chart of one embodiment of a method according to the present invention for operating the internal combustion engine according to FIG. 1.
Figure 3:
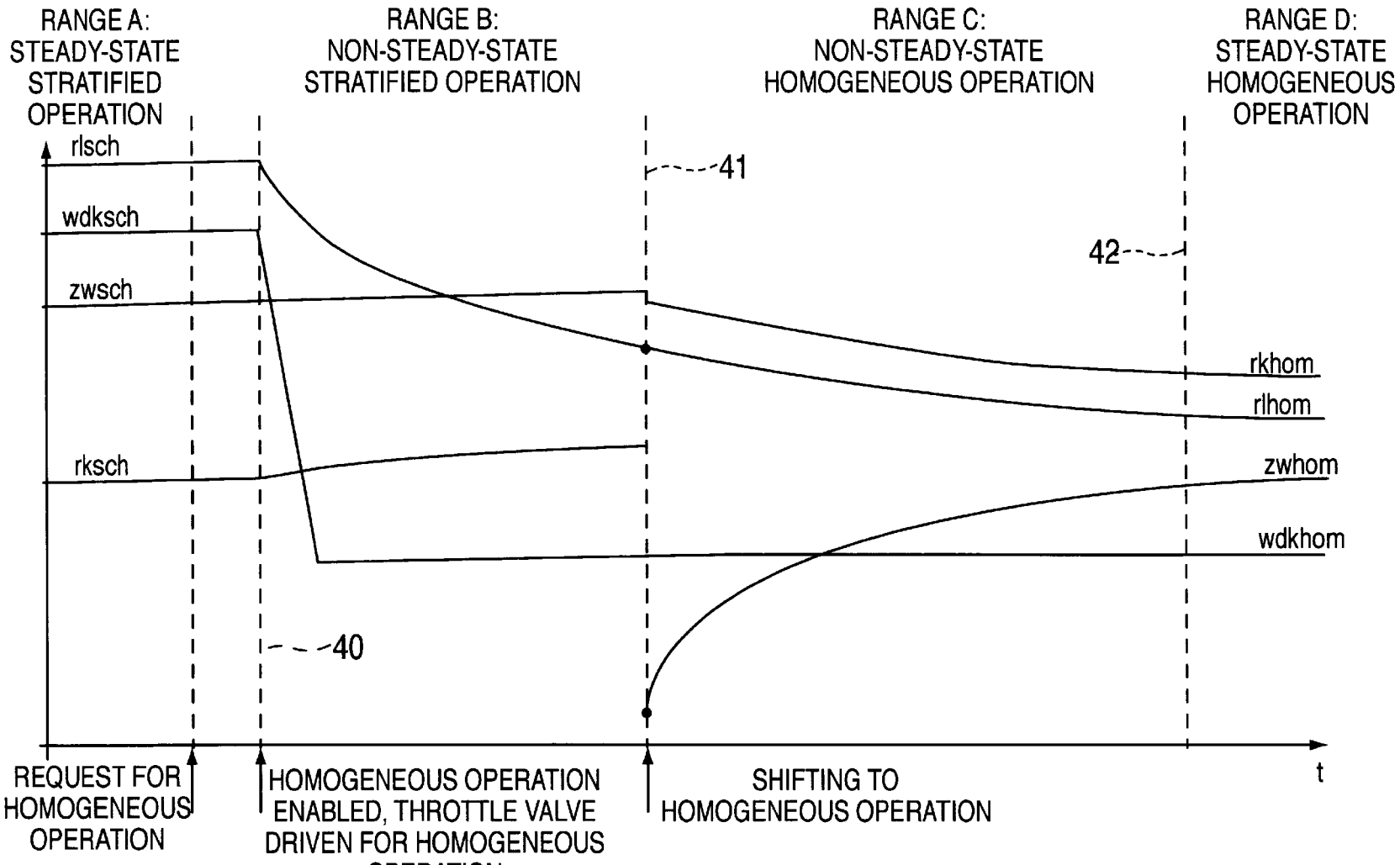
FIG. 3 shows a schematic time chart of signals of the internal combustion engine of FIG. 1 when carrying out the method according to FIG. 2,.

The method of shifting from stratified operation to homogeneous operation described below with reference to FIGS. 2 and 3 is carried out by control unit 16. Blocks shown in FIG. 2 represent functions of the method implemented, e.g., in the form of software modules or the like, in control unit 16.

In FIG. 2, it is assumed in a block 21 that internal combustion engine 1 is in a steady-state stratified operation. Then in a block 22, a transition to homogeneous operation is requested, e.g., on the basis of acceleration in the vehicle desired by the driver. FIG. 3 also shows the time of the request for homogeneous operation.

Then, debouncing is performed by blocks 23, 24, preventing rapid shifting back and forth between stratified operation and homogeneous operation. When homogeneous operation is enabled, the transition from stratified operation to homogeneous operation is started by a block 25. The time when the shifting operation begins is labeled with reference number 40 in FIG. 3.

At time 40, throttle valve 12 is controlled by a block 26 out of its completely opened state wdksch in stratified operation into an at least partially opened or closed state wdkhom for homogeneous operation. The rotational position of throttle valve 12 in homogeneous operation is oriented at a stoichiometric fuel/air mixture, i.e., at $\lambda=1$, and also depends on, e.g. the requested moment and/or rpm N of internal combustion engine 1, etc.

Through the adjustment of throttle valve 12, internal combustion engine 1 goes from steady-state stratified operation into a non-steady-state stratified operation. In this operating state, the air flow supplied to combustion chamber 4 drops gradually from a filling rlsch during stratified operation to smaller fillings. This is shown in FIG. 3. Air flow rl supplied to combustion chamber 4 or the filling of the combustion chamber is determined by control unit 16, inter alia, from signal LM of air flow sensor 10. According to a block 27, internal combustion engine 1 is still operated in stratified operation.

Then, a block 28 in FIG. 2 triggers a shift to a non-steady-state homogeneous operation. This is the case at time 41 in FIG. 3.

According to a block 29, fuel mass rk injected into combustion chamber 4 in homogeneous operation is controlled and/or regulated as a function of air flow rl supplied to combustion chamber 4 so that in particular a stoichiometric fuel/air mixture is obtained, i.e., $\lambda=1$. However, it is also possible for the fuel/air mixture to be adjusted to be rich or lean, i.e., to select $\lambda>1$ or $\lambda<1$.

Fuel mass rk influenced in this way results in moment Md delivered by internal combustion engine 1 being increased—at least for a certain period of time. This is compensated by the fact that at time 41, i.e., when shifting to homogeneous operation, firing angle ZW is adjusted from value zwsch so that delivered moment Md maintains a setpoint moment mdsoll derived from the requested moment, among other things, and thus it remains approximately constant.

To this end, fuel mass rk is determined from air flow rl supplied to combustion chamber 4 under the assumption of a stoichiometric fuel/air mixture. In addition, firing angle ZW is adjusted in the direction of retarded firing as a function of setpoint moment mdsoll. With regard to this retard adjustment, there is thus a certain deviation from normal homogeneous operation with which the excessive air flow supplied and the resulting excess moment generated of internal combustion engine 1 are temporarily dissipated.

A check is performed in a block 30 to determine whether air flow rl supplied to combustion chamber 4 has finally dropped to the filling belonging to steady-state homogeneous operation at a stoichiometric fuel/air mixture. If this is not yet the case, waiting is continued in a loop over block 29. However, if this is the case, operation of internal combustion engine 1 is continued in steady-state homogeneous operation without a firing angle adjustment by block 31. This is the case in FIG. 3 at a time labeled with reference number 42.

In this steady-state homogeneous operation, the air flow supplied to combustion chamber 4 corresponds to filling rlhom for homogeneous operation, and firing angle zwhom for sparkplug 9 also corresponds to that for homogeneous operation. The same also applies to rotational position wdkhom of throttle valve 12.

Figure 4:
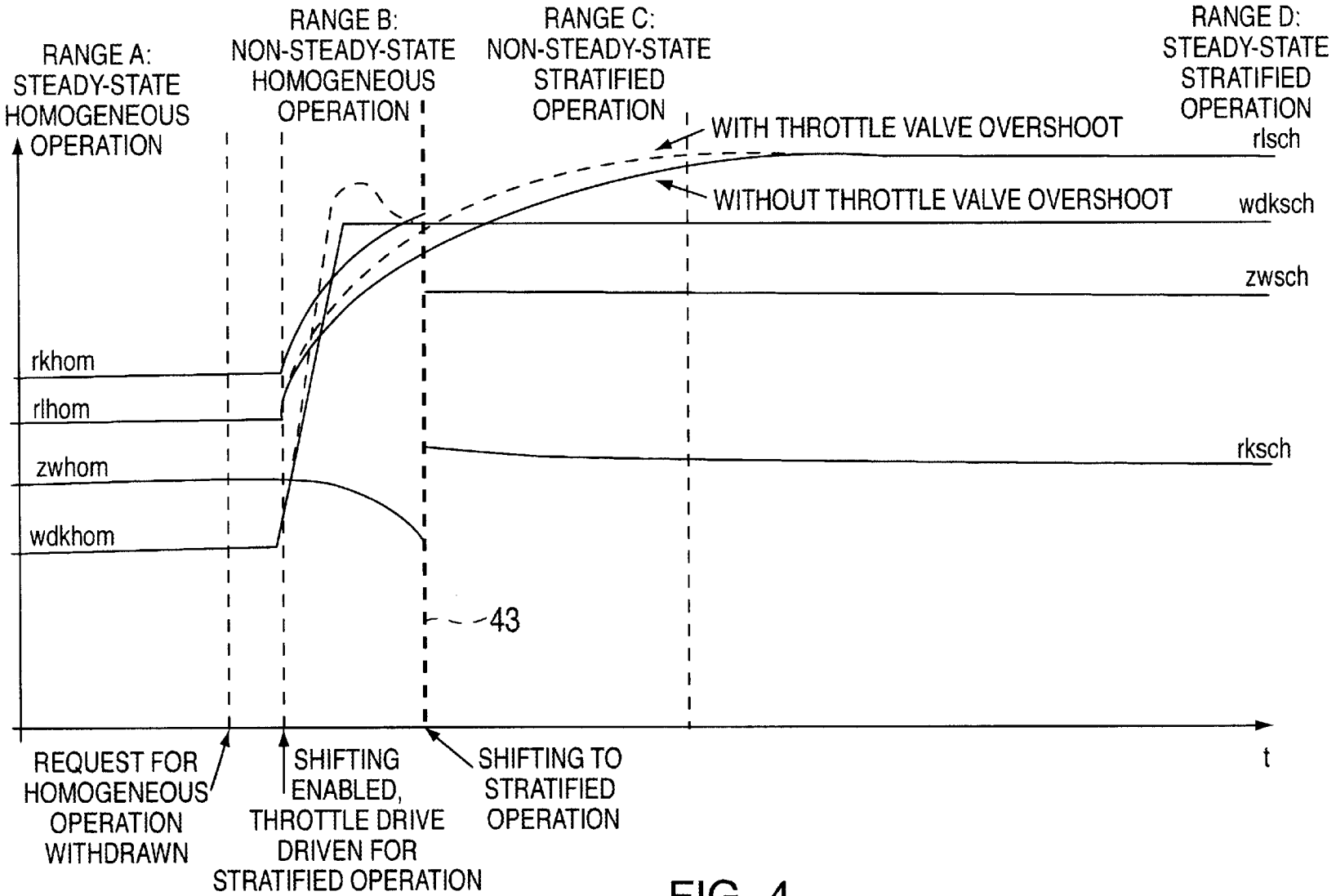
FIG. 4 shows a schematic time chart of signals of the internal combustion engine of FIG. 1 when carrying out a method opposite to that of FIG. 2.

FIG. 3 shows steady-state stratified operation as range A, non-steady-state stratified operation as range B, non-steady-state homogeneous operation as range C and steady-state homogeneous operation as range D. FIG. 4 shows shifting from homogeneous operation to stratified operation, where there is to be a shift to steady-state stratified operation from steady-state homogeneous operation on the basis of the performance quantities, for example, of internal combustion engine 1.

Shifting to stratified operation is initiated by control unit 16 by withdrawing the request for homogeneous operation. After debouncing, shifting to stratified operation is enabled, and throttle valve 12 is controlled to move into the rotational position intended for stratified operation. This is a rotational position at which throttle valve 12 is mostly open. This is represented by the transition from wdkhom to wdksch in FIG. 4.

It is possible for this transition to be processed further by control unit 16 with or without taking into account a throttle valve overshoot. This is represented by solid or dotted lines in FIG. 4.

Opening throttle valve 12 results in increased air flow rl supplied to combustion chamber 4. This is apparent from the curve for rlhom in FIG. 4. The shift from the non-steady-state homogeneous operation described here to non-steady-state stratified operation takes place after this. This is the case at time 43 in FIG. 4.

Before shifting to stratified operation, the increasing air flow supplied to combustion chamber 4 is compensated by increasing injected fuel mass rk and adjusting firing angle ZW to be retarded. This is apparent from the curves for rkhom and zwhom in FIG. 4.

After shifting to stratified operation, injected fuel mass rk is set at value rksch for stratified operation. The same applies to firing angle ZW which is set at value zwsch for stratified operation.

FIG. 4 shows steady-state homogeneous operation as range A, non-steady-state homogeneous operation as range B, non-steady-state stratified operation as range C and steady-state stratified operation as range D.

Figure 5:
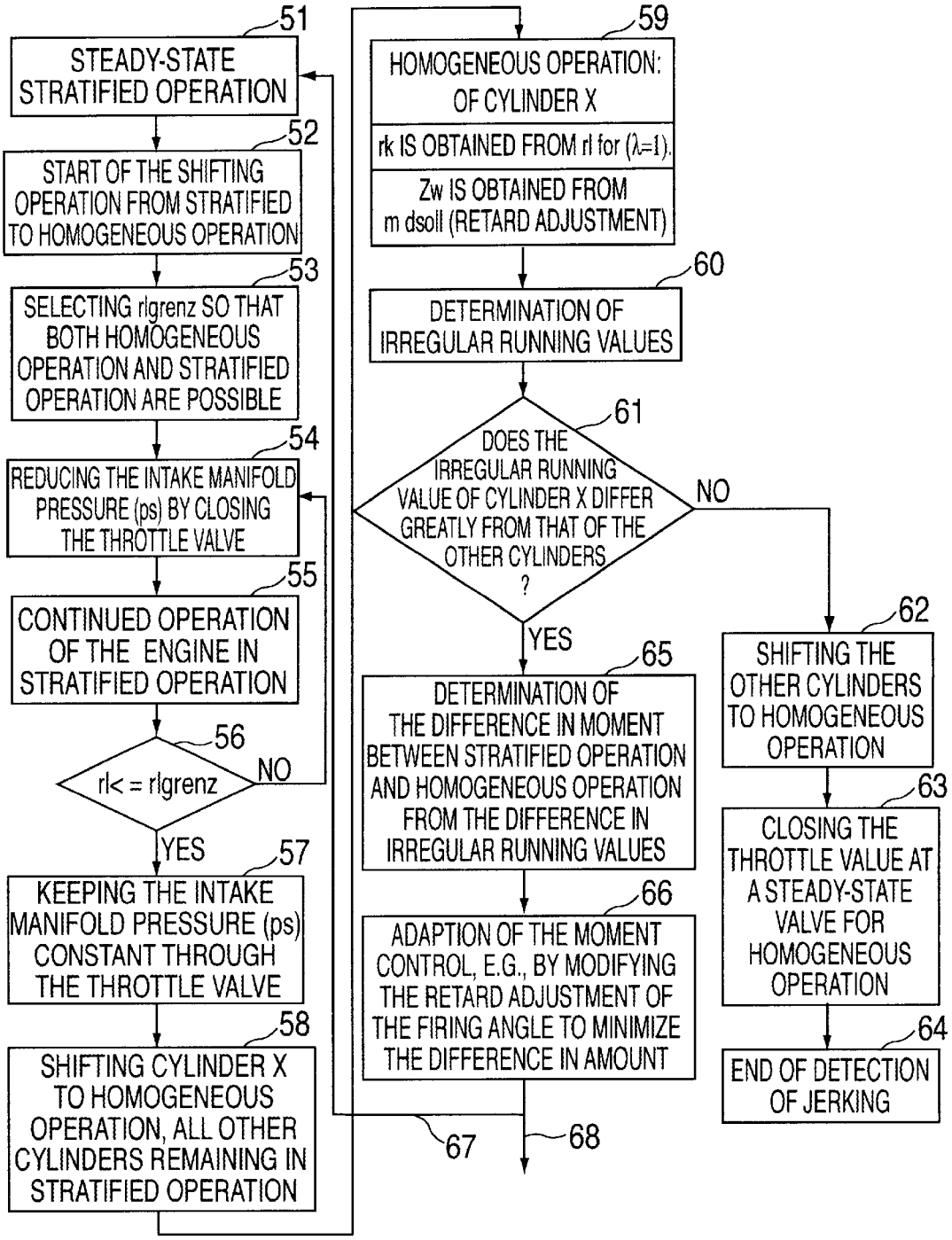
FIG. 5 shows a schematic flow chart of an embodiment of a method according to the present invention for shifting according to FIGS. 2 and 3.

FIG. 5 illustrates a method that can be employed when shifting from stratified operation to homogeneous operation according to FIGS. 2 and 3. This method is used to detect changes in torque of internal combustion engine 1, i.e., changes in actual moment Md delivered during the shifting operation. The blocks shown in FIG. 5 represent functions of the method implemented, e.g., in the form of software modules or the like in control unit 16.

According to a block 51, it is assumed that internal combustion engine 1 is in steady-state stratified operation. Shifting from stratified operation to homogeneous operation is started in a block 52.

The method described below for detecting and minimizing jerking that occurs dynamically when shifting is carried out as a quasi-steady-state method at different fillings rlgrenz in succession.

To this end, a limit value rlgrenz for the filling of combustion chamber 4 is selected in a block 53 so that this limit value rlgrenz can be used in both stratified and homogeneous operation.

According to a block 54, throttle valve 12 is closed. This results in a reduced air flow rl supplied to the combustion chamber and thus reduced filling in the combustion chamber. Pressure ps in intake manifold 6 of internal combustion engine 1, from which filling rl can be derived, is reduced because throttle valve 12 is closed. Regardless of these changes, internal combustion engine 1 is operated further in stratified operation according to block 55.

A check is performed in a block 56 to determine whether filling rl in combustion chamber 4 has dropped to limit value rlgrenz, i.e., whether rl≦rlgrenz. If this is not yet the case, the method is continued with block 54, i.e., in particular with further operation of internal combustion engine 1 in stratified operation according to block 55.

If rl≦rlgrenz, i.e., if filling rl in combustion chamber 4 of internal combustion engine 1 has reached limit value rlgrenz, then pressure ps in intake manifold 6 is kept approximately constant according to a block 57. This can be accomplished, e.g., by a suitable influence on throttle valve 12.

Then, in a block 58, one of cylinders 3 of internal combustion engine 1, e.g., the x-th cylinder, is shifted to homogeneous operation. However, all other cylinders 3 of internal combustion engine 1 remain in stratified operation.

According to a block 59, fuel mass rk is supplied to x-th cylinder 3 as a function of filling rl in combustion chamber 4 and for a stoichiometric fuel/air mixture, i.e., for $\lambda=1$. In addition, firing angle ZW or the firing point of x-th cylinder 3 is adjusted to be retarded as a function of setpoint moment mdsoll. Torque Md that would result due to injected fuel mass rk is thus reduced to the desired level of setpoint moment mdsoll by this retard adjustment.

Then, irregular running values are determined in a block 60. These irregular running values may be any values characterizing smooth or irregular running of internal combustion engine 1. For example, it is possible to provide internal combustion engine 1 with a sensor to detect smooth or irregular running of internal combustion engine 1. It is likewise possible for the irregular running of internal combustion engine 1 to be determined from other performance quantities of internal combustion engine 1, in particular those that are already available. In particular, it is possible for the irregular running to be calculated from rpm N of internal combustion engine 1.

The smooth or irregular running of internal combustion engine 1 represents a measure of changes in actual moment Md of internal combustion engine 1. In particular, the smooth or irregular running represents a measure of the differences in torque between successively fired cylinders 3 of internal combustion engine 1. To this end, it is possible to assign the smooth or irregular running to individual cylinders 3 of internal combustion engine 1.

A method of determining the smooth or irregular running of internal combustion engine 1 is explained below. It should be pointed out explicitly that the method described here is given only as an example and can be replaced and/or supplemented by any other methods of determining smooth or irregular running.

To determine irregular running of internal combustion engine 1, segment times ts are measured during the operation of internal combustion engine 1. One segment time ts is measured with each combustion. A number n is assigned to each combustion, and the respective segment time is characterized as ts(n) accordingly. For example, a crankshaft angle of 360 degrees divided by half the number of cylinders is selected as a segment and assigned to each cylinder 3 of internal combustion engine 1. In particular, it is possible to arrange the segment symmetrically with the top dead center of respective cylinder 3.

Segment times ts(n) which depend on combustion are detected, e.g., with the help of a sensor which measures the duration of the passing of the respective segment past a reference point. The sensor may be rpm sensor 15 in particular. Segment times ts(n) measured by the sensor at the same time represent rpm information from which the rpm characteristic and thus also rpm fluctuations can be derived for respective cylinder 3.

By using comparison functions and optionally adaption functions, it is possible to determine system-induced fluctuations in rpm and have them compensated or disregarded in the calculation of irregular running [values]. These may be, for example, manufacturing tolerances or vibrations or the like. Such compensated segment times tsk(n) thus depend essentially only on fluctuations in torque for the individual cylinder.

The irregular running value is calculated from these compensated segment times tsk(n), for example, as follows:

$$lut(n)=(tsk(n+1)-tsk(n)/tsk(n)^3)$$

For each power stroke, j irregular running values lut(z, j) for each individual cylinder are obtained by assigning irregular running values lut(n), numbered continuously according to combustions n, to a number z of cylinders 3 of internal combustion engine 1, for example. These irregular running values lut(z, j) can be filtered by using appropriate algorithms. For example, it is possible to perform a low-pass filtering to suppress stochastic interference. Such filtered irregular running values flut(z, j) for each individual cylinder represent the above-mentioned measure of differences in torque between successively fired cylinders 3 of internal combustion engine 1.

If irregular running values lut(n) and/or lut(z, j) and/or flut(z, j) have been determined in block 60, for example, by the method described here, these values are used further in the method described below. As mentioned previously, however, irregular running values determined by other methods may also be used accordingly in the method described below.

A check is performed in a block 61 to determine whether the irregular running value of cylinder x, which has already been shifted to homogeneous operation, differs greatly or significantly from the irregular running values of the other cylinders. A threshold value can be selected for the difference in irregular running values; when exceeded, there is a significant deviation.

If cylinder x, which has already been shifted to homogeneous operation, does not have any significant deviation with regard to its irregular running values in comparison with the other cylinders, then the other cylinders are also shifted to homogeneous operation in a block 62. In a downstream block 63, throttle valve 12 is set at a steady-state value for homogeneous operation, and internal combustion engine 1 is operated further in steady-state homogeneous operation. In addition, detection of jerking in a block 64 is terminated.

However, if the irregular running values of cylinder x, which has already been shifted to homogeneous operation, differ significantly from the irregular running values of the other cylinders, a difference in moment for each cylinder, characterizing the difference between stratified operation and homogeneous operation for this cylinder, is determined in a block 65 from the difference in irregular running values.

On the basis of this cylinder-specific difference in moment, the moment control is influenced adaptively in a block 66. For example, the difference in moment between stratified operation and homogeneous operation can be minimized or reduced to zero by a change in the retard adjustment of firing angle ZW. The same can also be achieved by influencing fuel mass rk supplied.

After block 66, internal combustion engine 1 can be returned to steady-state stratified operation again. Thus, in this case it is not shifted completely to homogeneous operation, but instead cylinder x, which is the only cylinder already shifted to homogeneous operation, is shifted back to stratified operation. This procedure is then continued via arrow 67 with block 51, with a new limit value rlgrenz being selected in block 53 for the filling of combustion chamber 4.

As an alternative, internal combustion engine 1 may also be shifted completely to homogeneous operation after block 66. Then the other cylinders are also shifted to homogeneous operation. This is indicated with arrow 68 in FIG. 5.

If changes in actual moment Md of internal combustion engine 1 during the shifting operation are detected by the method according to FIG. 5, countermeasures are taken in block 66, as mentioned previously. These countermeasures generally involve changes in performance quantities of internal combustion engine 1 with which actual moment Md of internal combustion engine 1 is influenced.

In shifting from stratified operation to homogeneous operation according to FIGS. 2 and 3, firing angle ZW or the firing point is adjusted to be retarded when changes in torque are found in range C so as to compensate for excessive filling rl of combustion chamber 4 as well as the difference in moment detected at this point and thus to reduce changes in torque. The same applies to shifting from homogeneous operation to stratified operation in range B in FIG. 4. Such changes in torque are dynamic torque changes that can be corrected permanently by adaptive changes in the above-mentioned performance quantities.

When changes in torque are found in range C when shifting from homogeneous operation to stratified operation according to FIG. 4, fuel mass rk to be injected into combustion chamber 4 is reduced or increased in such a way as to reduce the determined torque changes. The same is true of shifting from stratified operation to homogeneous operation in range B in FIG. 3. Such changes in torque are dynamic torque changes which can be corrected permanently by adaptive changes in the above-mentioned performance quantities.

The above-mentioned influences on performance quantities of internal combustion engine 1 to compensate for irregular running or bucking during a shifting operation can be performed immediately, so there may be an effect during the instantaneous shifting operation. However, it is also possible for the influences to be implemented in such a way that the effect does not occur until the next shifting operation.

What is claimed is:

1. A method of operating an internal combustion engine in a motor vehicle, comprising:

injecting fuel directly into a combustion chamber during a compression phase in a first operating mode and during an intake phase in a second operating mode;

shifting between the first operating mode and the second operating mode;

influencing an actual moment of the internal combustion engine as a function of at least one of an injected fuel mass, a firing angle and a firing point;

at least one of controlling and regulating at least one of the injected fuel mass, the firing angle and the firing point differently as a function of a setpoint moment in both of the first operating mode and the second operating mode;

determining a change in the actual moment during the shifting between the first operating mode and the second operating mode; and influencing at least one of the injected fuel mass, the firing angle and the firing point as a function of the determined change.

2. The method according to claim 1, wherein the determining step includes determining the change in the actual moment when shifting from the first operating mode to the second operating mode.

3. The method according to claim 1, wherein the determining step includes determining the change in the actual moment in succession at different fillings of the combustion chamber.

4. The method according to claim 1, wherein the determining step includes determining the change in the actual moment as a function of a measured rpm of the internal combustion engine.

5. The method according to claim 1, wherein the second influencing step includes adaptively influencing at least one of the injected fuel mass, the firing angle and the firing point.

6. The method according to claim 1, wherein the second influencing step includes influencing at least one of the injected fuel mass, the firing angle and the firing point only after the shifting step.

7. The method according to claim 1, wherein the second influencing step includes increasing the injected fuel mass in the first operating mode.

8. The method according to claim 1, wherein the second influencing step includes influencing at least one of the firing angle and the firing point in the second operating mode with a retard adjustment.

9. An internal combustion engine for a motor vehicle, comprising:

a fuel injection valve injecting fuel directly into a combustion chamber during a compression phase in a first operating mode and during an intake phase in a second operating mode; and a control unit shifting the internal combustion engine between the first operating mode and the second operating mode, the control unit influencing an actual moment of the internal combustion engine as a function of at least one of an injected fuel mass, a firing angle and a firing point, at least one of controlling and regulating at least one of the injected fuel mass, the firing angle and the firing point differently as a function of a setpoint moment in both of the first operating mode and the second operating mode, the control unit determining a change in the actual moment during the shifting, and the control unit influencing at least one of the injected fuel mass, the firing angle and the firing point as a function of the determined change.

10. A method of operating an internal combustion engine in a motor vehicle, comprising:

injecting fuel directly into a combustion chamber during a compression phase in a first operating mode and during an intake phase in a second operating mode;

shifting between the first operating mode and the second operating mode;

influencing an actual moment of the internal combustion engine as a function of at least one of an injected fuel mass, a firing angle and a firing point;

at least one of controlling and regulating at least one of the injected fuel mass, firing angle and the firing point differently as a function of a setpoint moment in both of the first operating mode and the second operating mode;

determining a change in the actual moment during the shifting between the first operating mode and the second operating mode;

influencing at least one of the injected fuel mass, the firing angle and the firing point as a function of the determined change; and determining irregular running values for individual cylinders of the internal combustion engine.

11. The method according to claim 10, wherein the shifting step includes, at first, shifting only one of the cylinders, the method further comprising the step of comparing at least one of the irregular running values of the one of the cylinders with at least one of the irregular running values of at least one of the other cylinders.

12. The method according to claim 11, wherein the shifting step includes shifting others of the cylinders as a function of the comparing step.

13. The method according to claim 12, wherein if a predetermined threshold value is exceeded, the others of the cylinders are not shifted.

14. The method according to claim 11, wherein the second influencing step includes influencing at least one of the injected fuel mass, the firing angle and the firing point as a function of the comparing step.

* * * * *

UNITED STATES PATENT AND TRADEMARK OFFICE

CERTIFICATE OF CORRECTION

PATENT NO. : 6,446,596 B1
DATED : September 10, 2002
INVENTOR(S) : Winfried Moser et al.

It is certified that error appears in the above-identified patent and that said Letters Patent is hereby corrected as shown below:

Column 1,
Line 5, delete "Background Information".
Line 26, insert -- BACKGROUND INFORMATION --.

Column 2,
Line 20, change "The object" to -- An object --.
Line 23, delete "with a method of the type defined in and".

Signed and Sealed this

Twenty-third Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,446,596 B1
DATED : September 10, 2002
INVENTOR(S) : Winfried Moser et al.

It is certified that error appears in the above-identified patent and that said Letters Patent is hereby corrected as shown below:

Column 1,
Line 5, delete "Background Information".
Line 26, insert -- BACKGROUND INFORMATION --.

Column 2,
Line 20, change "The object" to -- An object --.
Line 23, delete "with a method of the type defined in and".

Signed and Sealed this

Twenty-first Day of October, 2003

JAMES E. ROGAN
*Director of the United States Patent and Trademark Office*